US006755366B2

(12) United States Patent
Polk

(10) Patent No.: US 6,755,366 B2
(45) Date of Patent: Jun. 29, 2004

(54) DEVICE FOR DIRECT INSERTION OF YARN IN AUTOMATIC WINDER

(75) Inventor: James E. Polk, Pensacola, FL (US)

(73) Assignee: Solutia Inc., St. Louis, MO (US)

( * ) Notice: Subject to any disclaimer, the term of this patent is extended or adjusted under 35 U.S.C. 154(b) by 0 days.

(21) Appl. No.: 10/259,491

(22) Filed: Sep. 30, 2002

(65) Prior Publication Data

US 2004/0061020 A1 Apr. 1, 2004

(51) Int. Cl.[7] ..... B65H 59/22
(52) U.S. Cl. ..... 242/149; 242/472.8
(58) Field of Search ..... 242/472.8, 149, 242/150 R, 419.4; 226/195

(56) References Cited

U.S. PATENT DOCUMENTS

| | | | | |
|---|---|---|---|---|
| 2,981,497 A | * | 4/1961 | Schurich | 242/149 |
| 3,249,312 A | * | 5/1966 | Current | 242/472.8 |
| 3,328,947 A | * | 7/1967 | Gibson | 242/472.8 |
| 3,903,681 A | * | 9/1975 | Bous | 242/472.8 |
| RE31,594 E | | 6/1984 | Mima | |
| 4,548,369 A | * | 10/1985 | Bossart | 242/150 R |
| 4,605,182 A | * | 8/1986 | Zollinger | 242/149 |
| 4,612,150 A | | 9/1986 | De Howitt | |
| 4,805,846 A | | 2/1989 | Ueda et al. | |
| 4,900,495 A | | 2/1990 | Lin | |
| 4,943,009 A | * | 7/1990 | Gerstner-Stevens et al. | 242/472.8 |
| 5,050,816 A | * | 9/1991 | Niederer | 242/149 |
| 5,056,734 A | | 10/1991 | Uchida et al. | |
| 5,179,829 A | | 1/1993 | Grecksch et al. | |
| 5,277,855 A | | 1/1994 | Blackmon et al. | |
| 5,492,286 A | * | 2/1996 | Motta | 242/149 |
| 5,605,296 A | | 2/1997 | Haasen et al. | |
| 5,772,136 A | * | 6/1998 | Gilbos et al. | 242/472.8 |
| 5,927,629 A | * | 7/1999 | Dixon | 242/150 R |

FOREIGN PATENT DOCUMENTS

| | | | |
|---|---|---|---|
| EP | 0 327 773 B1 | | 6/1988 |
| JP | 62215470 A | * | 9/1987 |
| WO | WO 99/14408 | | 3/1999 |

* cited by examiner

*Primary Examiner*—William A. Rivera
(74) *Attorney, Agent, or Firm*—Banner & Witcoff, Ltd.; John P. Foryt, Esq.

(57) ABSTRACT

An insertion mechanism brings an insert yarn into association with a base yarn in an automatic winder. The insertion mechanism comprises an insertion guide for delivering the insert yarn to a predetermined location on the winder, and a tensioning device for maintaining tension on the insert yarn. In another aspect, an automatic winder is configured or modified for direct insertion. In contrast to conventional creel frame insertion, the direct insertion technique of the invention avoids the need for a separate step of back-winding, and allows the automatic doffing feature on the winder to be enabled.

14 Claims, 9 Drawing Sheets

DEVICE FOR DIRECT INSERTION OF YARN IN AUTOMATIC WINDER

FIELD OF THE INVENTION

The present invention is directed to devices for yarn winding and, more particularly, to devices for co-winding a carrier yarn together with an insert yarn to form a two-ply yarn.

BACKGROUND OF THE INVENTION

Automatic winders are widely used for winding yarn from spinning bobbins onto packages of predetermined yarn quantity and shape. A winder usually has a bobbin holder for housing several spinning bobbins. In a typical configuration, the yarn on the spinning bobbin is fed to a predetermined position on the winder where it is pulled upward in the axial direction of the bobbin. The yarn is taken up to a package while being traversed by a traversing device. Examples of automatic winders are described in U.S. Pat. No. 5,056,734 to Uchida et al. and U.S. Pat. No. 4,805,846 to Ueda et al. Other examples of automatic winders include those manufactured by W. Schlafhorst AG & Co., such as the winder described in U.S. Pat. No. 5,605,296 to Haasen et al. and the combined textile yarn spinning and winding system disclosed in U.S. Pat. No. 5,179,829 to Grecksch et al.

Multi-bobbin automatic winders usually are equipped with an automatic doffing feature. As yarn is being unwound from one of the bobbins, the yarn ends from the other bobbins are held by a holding means. When the yarn being unwound from the bobbin expires, one of the awaiting yarn ends is engaged and fed to a splicing mechanism. The end of the yarn from the expired bobbin is spliced with the leading end of the yarn from the fresh bobbin, after which time normal winding resumes. An example of a splicing mechanism for an automatic winder is described in U.S. Pat. No. Re 31,594 to Mima, the disclosure of which is incorporated by reference.

In many applications, it is desirable to co-wind a base yarn with another yarn to form a two-ply yarn. When preparing yarns for use in carpets, for example, a low-melt binder fiber often is inserted into a base fiber prior to winding. Examples of base fibers commonly used in carpets include polyesters, nylon-6, and nylon-6,6. Examples of binder fibers commonly used include co-polyamides as described in WO 99/14408 A1 and EP 324,773 B1. When the two-ply yarn is exposed to normal twist setting conditions, the binder fiber melts and flows to the points of intersecting base fibers. As the yarn cools, a bond is formed between the base fibers. Carpets made from these types of yarns have improved performance characteristics, particularly wear resistance.

Another common example of a two-ply carpet yarn is one in which a base yarn is co-wound with an electrically conductive filament. The conductive filament helps to reduce static propensity in the carpet. U.S. Pat. No. 4,612,150 to De Howitt shows an example of a low denier, conductive filament. The filament contains a polymeric component and carbon black to provide electrical conductivity. The bi-component filament is prepared as a sheath/core, with the non-conductive component fully encapsulating a conductive core. Other examples of conductive filaments are described in U.S. Pat. No. 4,900,495 to Lin and U.S. Pat. No. 5,277,855 to Blackmon et al.

The presently used technique for preparing two-ply yarns is creel frame insertion, as illustrated in FIG. 1. Creel frame insertion introduces a back-winding step between spinning and winding. The back-winding step is needed to convert the spinning bobbins into larger round bobbins (sometimes referred to as "cheese" bobbins). The smaller spinning bobbins are unsuitable for use in creel frame insertion because the high linear velocities, typically on the order of 1,200 m/min, would require operators to replace expired spinning bobbins with fresh bobbins at an impractically high frequency.

The present creel frame insertion technique suffers from several drawbacks. One of the drawbacks is that the creel frame unit is rather bulky and consumes valuable floor space in mills. A principal drawback is the need for the separate back-winding step. The back-winding step increases the overall amount of time needed from spinning to winding, reducing process efficiency. In addition, the creel frame insertion technique requires that the automatic doffing feature on the winders be disabled.

It would be desirable to develop an alternative technique for inserting yarn prior to winding, especially one that eliminates the need for a creel frame and the need for back-winding. It would be particularly desirable to develop an insertion technique that also permits the automatic doffing feature on the winders to be used.

SUMMARY OF THE INVENTION

The present invention, according to one aspect, is directed to an insertion mechanism for bringing an insert yarn into association with a base yarn in an automatic winder of the type in which a base yarn is drawn out from a layer of yarn on a spinning bobbin and is rewound onto a package. The insertion mechanism comprises an insertion guide for feeding the insert yarn to a predetermined location, a tensioning device for maintaining tension on the insert yarn, and a mounting bracket adapted to permit attachment of the insertion mechanism to an automatic winder.

Another aspect of the present invention is directed to an automatic winder for drawing out a base yarn from a layer of yarn on a spinning bobbin and rewinding the base yarn onto a package together with an insert yarn. The automatic winder comprises a winding unit operable for drawing out and rewinding a base yarn onto a package together with an insert yarn. The winder has an insertion guide for feeding an insert yarn to a predetermined location of the automatic winder. A tensioning device maintains tension on the insert yarn as it is fed to the predetermined location of the winder.

Yet another aspect of the present invention is directed to a method of rewinding a base yarn from a layer of yarn on a spinning bobbin onto a package together with an insert yarn. An automatic winder having winding unit operable for drawing out and rewinding a base yarn onto a package is provided. An insert yarn is fed to a predetermined location of the automatic winder and into association with the drawn-out base yarn while tension is maintained on the insert yarn. The base yarn and the insert yarn are rewound together onto a package.

The present invention provides an efficient and effective alternative to the creel frame insertion method currently used for preparing two-ply yarns. The insert yarn is conveniently fed directly into the automatic winder used for rewinding the base yarn from the spinning bobbins onto a package, thereby avoiding the need for back-winding the base yarn onto larger bobbins prior to re-winding. The present invention also permits doffing in winders having an automatic doffing feature. Thus, the present invention overcomes several of the drawbacks associated with present techniques used for preparing two-ply yarns for winding.

BRIEF DESCRIPTION OF THE DRAWINGS

The objects, features, and advantages of the invention will be apparent from the following more detailed description of certain embodiments of the invention and as illustrated in the accompanying drawings in which.

DETAILED DESCRIPTION OF THE INVENTION

The direct insertion technique of the present invention is useful for winding a base yarn with an insert yarn, each of which may be made from a wide variety of materials. Non-limiting examples of base yarns include polyester, nylon-6, nylon-6,6, polypropylene, acrylic, and wool. Non-limiting examples of insert yarns include polyester, nylon-6, nylon-6,6, polyamide copolymers, spandex (including spandex fiber in the form of continuous monofilaments such as LYCRA®), acrylic, and conductive fibers. In general, the direct insertion technique of the present invention may be used in any environment in which a spun yarn is wound or rewound onto a package and in which one or more additional yarns are inserted, blended, or otherwise combined with the spun yarn to alter the physical properties or other characteristics of the overall yarn. The term "two-ply yarn," as used herein, refers to a base yarn that has been combined with at least one additional yarn prior to winding. Thus, the term "two-ply yarn" is inclusive of yarns formed from two, three, or more yarns. For convenience, the term "base yarn" is used herein to refer to the yarn that has the highest denier relative to the other yarns present, while the term "insert yarn" is used to refer to the yarn that is combined with the base yarn, e.g., to alter the physical properties of the two-ply yarn, and which typically has a lower denier than the base yarn. The present invention, however, is not limited to any particular yarn construction or properties. The direct insertion technique described herein could be used, for example, to combine two or more yarns of the same or similar denier.

There are many types of applications for which it may be desirable to prepare two-ply yarns. When preparing yarns for use in carpets, for example, a low-melt binder fiber often is inserted into a base fiber prior to winding. Examples of binder fibers include co-polyamides as described in WO 99/14408 A1 and EP 324,773 B1. The binder fiber provides carpets with improved properties, such as wear resistance. Conductive filaments also are commonly co-wound with base yarns to reduce static propensity in carpets, as described in U.S. Pat. No. 4,612,150 to De Howitt, U.S. Pat. No. 4,900,495 to Lin, and U.S. Pat. No. 5,277,855 to Blackmon et al., the disclosures of which each are hereby incorporated by reference.

Figure 1:
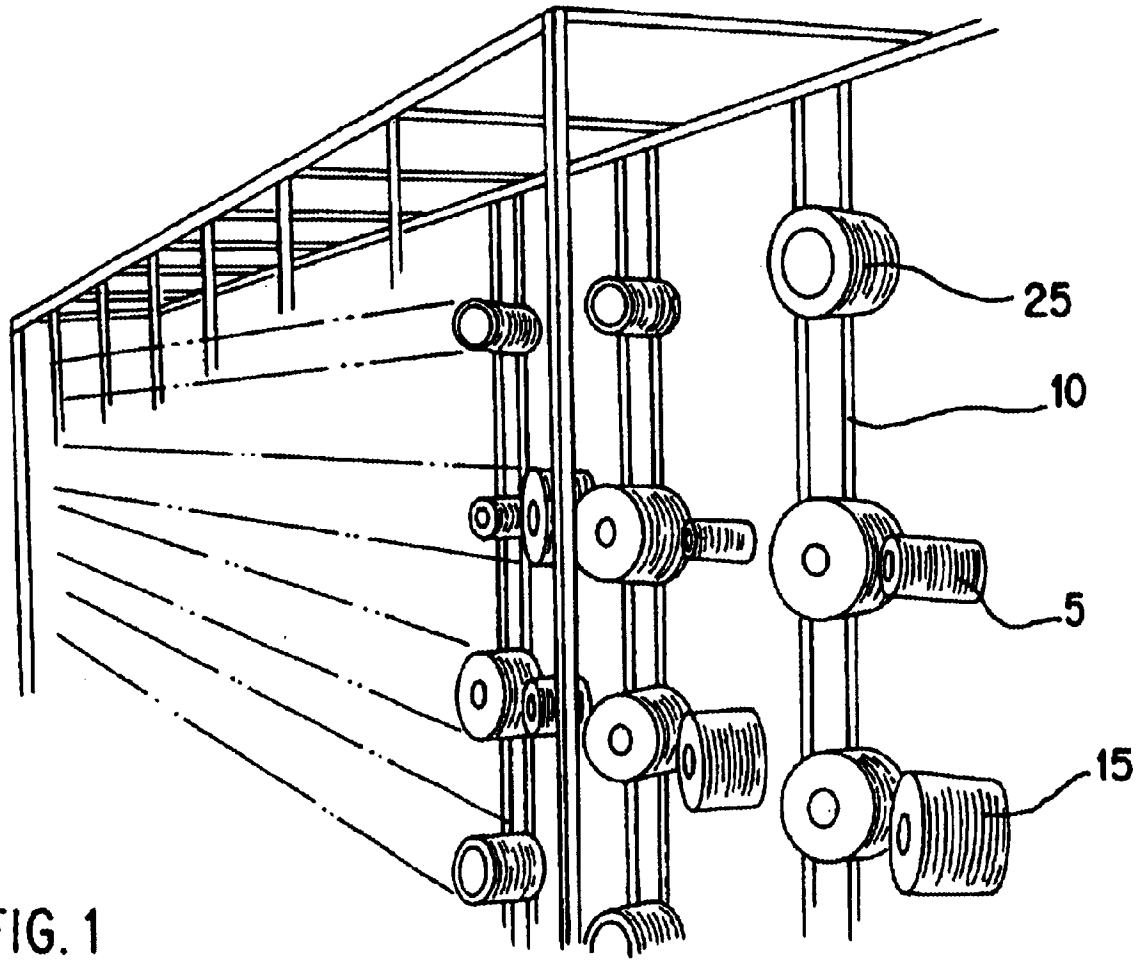
FIG. 1 PRIOR ART
FIG. 1 is a perspective view of a creel frame conventionally used for combining an insert yarn with a base yarn in advance of winding.

FIG. 1 is an example of equipment used for conventional creel frame insertion. A large frame 10 typically holds several insert yarn bobbins 25. The base yarn is back-wound from spinning bobbins 5 onto large round bobbins 15. The base yarn from the large round bobbins 15 then is combined with the insert yarn prior to rewinding the two-ply yarn onto a package. As shown in FIG. 1, the creel frame is quite large and consumes a significant amount of floor space. Also, the back-winding is an additional step that introduces significant time, expense, and inefficiencies into the overall winding process.

The direct insertion technique of the present invention can be used in connection with any automatic winder designed for winding yarn from a spinning bobbin onto a package. The present invention is not limited to any particular type of automatic winder. Existing winders can be retrofitted with a direct insertion mechanism as described herein, or a winder can be designed to include appropriate structure for direct insertion. It should be understood that the automatic winders described and shown herein are illustrative rather than limiting.

Figure 2:
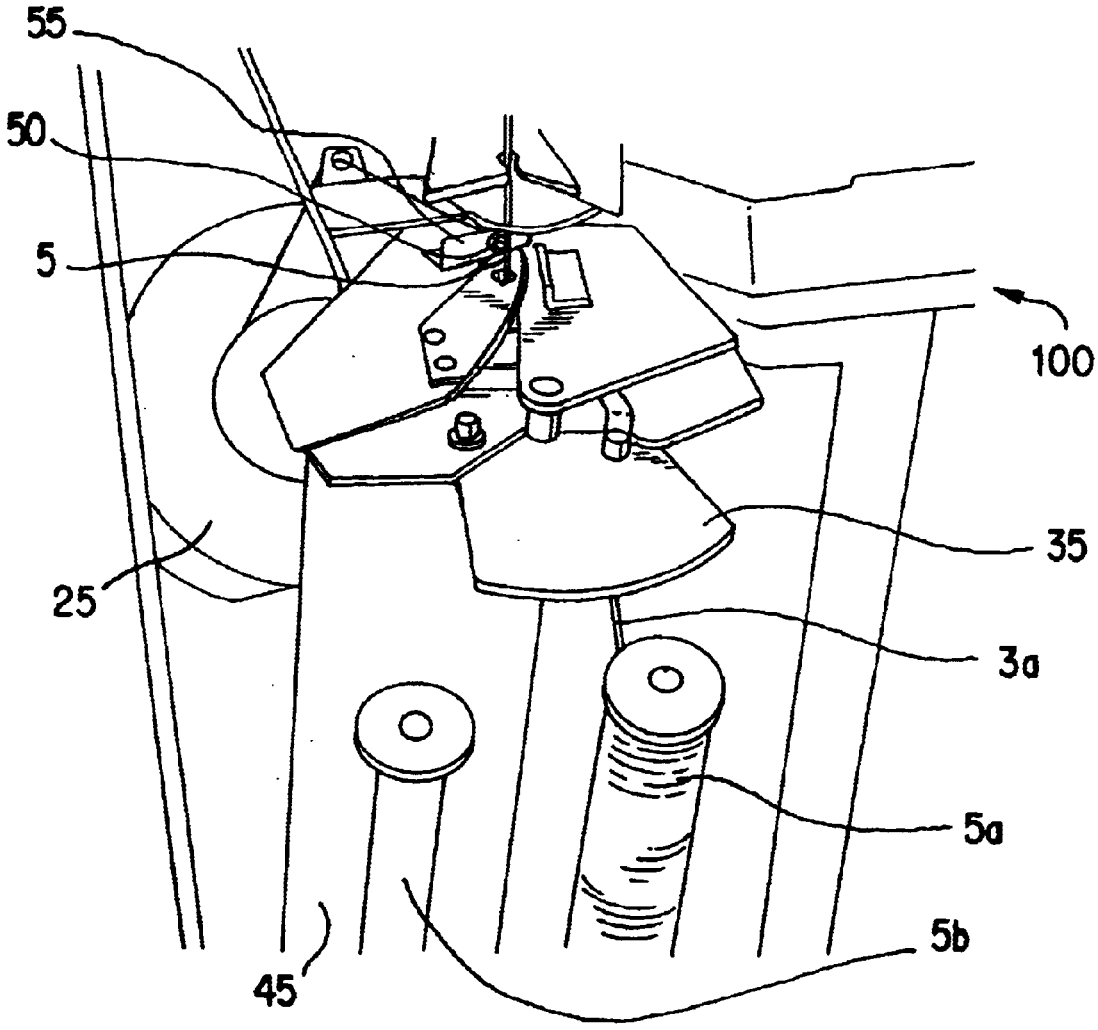
FIG. 2 is a front view of an automatic winder having an insertion mechanism in accordance with one embodiment of the invention, wherein the winder is equipped with an automatic doffing feature.

FIG. 2 illustrates an automatic winder 100 having an automatic doffing feature. A rotatable bobbin holder 45 houses three bobbins: 5*a*, 5*b*, and a third bobbin not visible in this particular view. In the winder 100 shown, one bobbin 5*b* is spent, and the other visible bobbin 5*a* is in the ready position, with the leading end of the yarn. 3*a* being held by a holding mechanism 35. When the yarn 5 is completely unwound from the spinning bobbin (not visible), the leading end of the yarn 3*a* is fed to the winding position, e.g., in front of the re-tie plate 55. A take-up arm (not illustrated) engages the leading end of the yarn 3*a*, and a splicing mechanism (not illustrated) splices the leading end of the yarn 3*a* to the trailing end of the expiring yarn 5. Once the splice is made, winding of the yarn resumes onto the package (not shown). As this occurs, the bobbin holder 45 rotates so that the spinning bobbin 5*a* currently in use is positioned below the winding position. The automatic winder shown in FIG. 2 also has an insertion guide 50 and a insert yarn bobbin 25 in accordance with the present invention, as described more fully below.

The splicing mechanism, traversing device, as well as other features of the winder not described in detail herein can be of conventional construction and form no part of the present invention.

Figure 3:
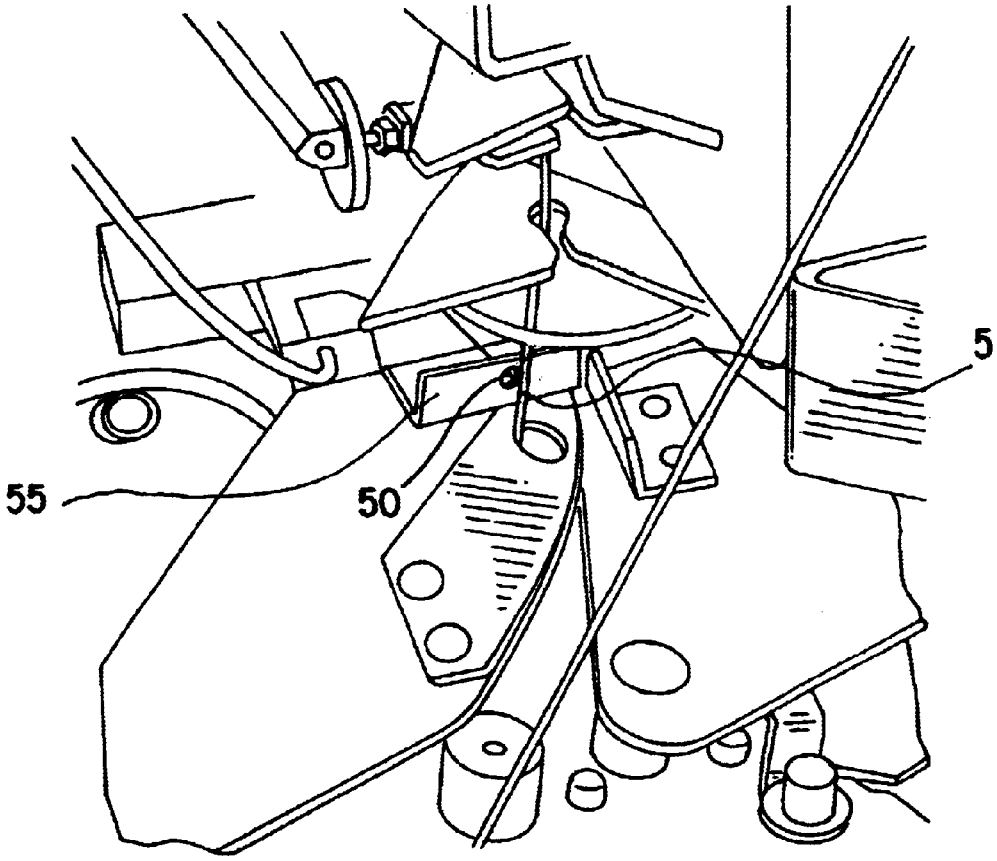
FIG. 3 is a front view of a direct insertion guide mounted to an automatic winder in accordance with one embodiment of the invention.

In accordance with a preferred practice of the invention as illustrated in FIGS. 2 and 3, the insertion guide 50 delivers the insert yarn from the bobbin 25 to the position on the winder where the base yarn 5 is engaged by the take-up arm for splicing. During splicing, the take-up arm engages both the base yarn 5 and the insert yarn 7. In the device illustrated in FIGS. 2 and 3, the insertion guide 50 is made simply by drilling a hole in the preexisting re-tie plate 55. This permits the insert yarn 7 to be conveniently fed from the rear of the winder 100. Depending on the configuration of the particular winder used, an insertion guide 50 can be fashioned to deliver the insert yarn to a suitable position of the winder at which it can be joined with the base yarn 5 in advance of winding. While a hole is illustrated, other suitable structures may be used for guiding the insert yarn 7, such as a groove, notch, or the like.

An important feature of the present invention is a tensioning mechanism for maintaining proper tension on the insert yarn. As will be apparent to persons skilled in the art, maintaining appropriate tension is particularly important when combining lower denier insert yarns with higher denier base yarns. A wide variety of types of tensioning mechanism can be used, as are well known to persons of ordinary skill, and should be regarded as being within the scope of the present invention. Selection of an appropriate tensioning mechanism can be made in accordance with the properties of the insert and base yarns (e.g., composition and denier), the structure of the particular winder used, and other factors that will be apparent to persons of ordinary skill in the art with the aid of no more than routine experimentation.

Figure 4:
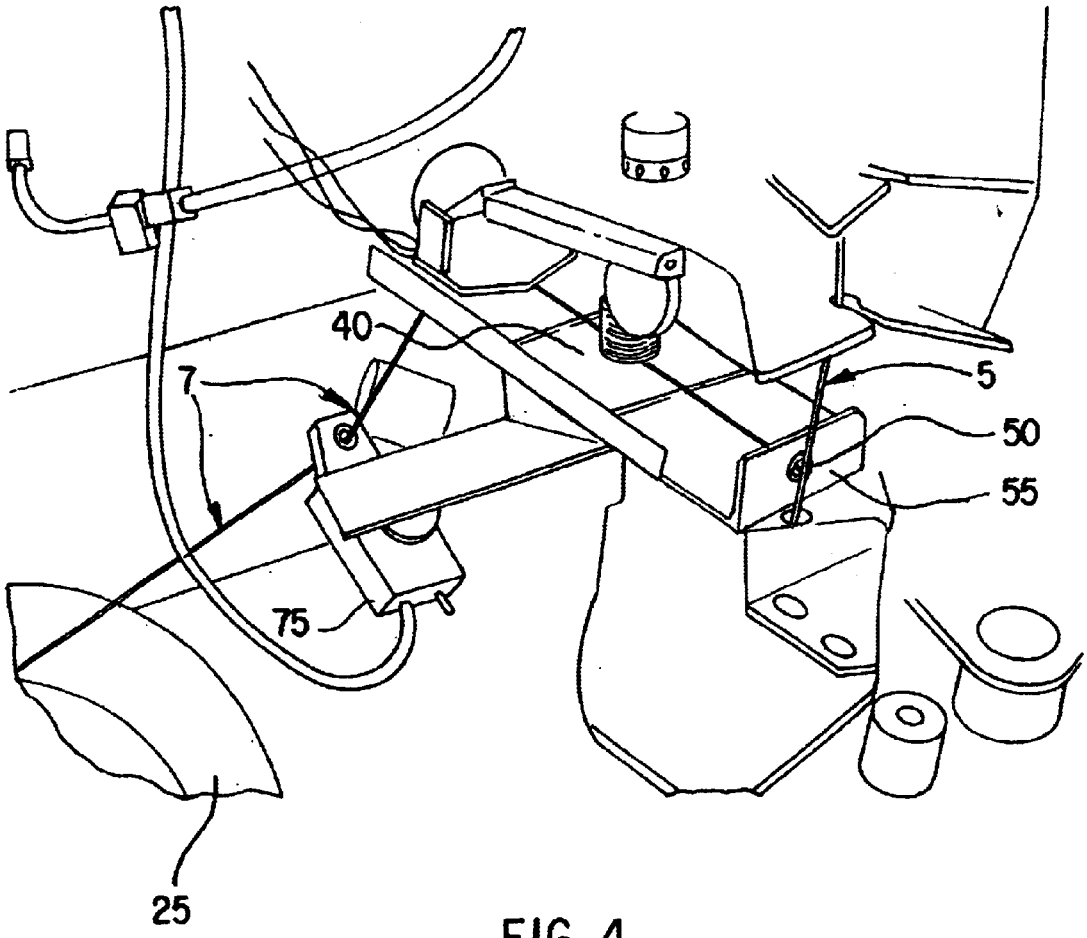
FIG. 4 is an illustration of a static tensioning plate for tensioning an insert yarn in accordance with a preferred embodiment of the invention.
Figure 8:
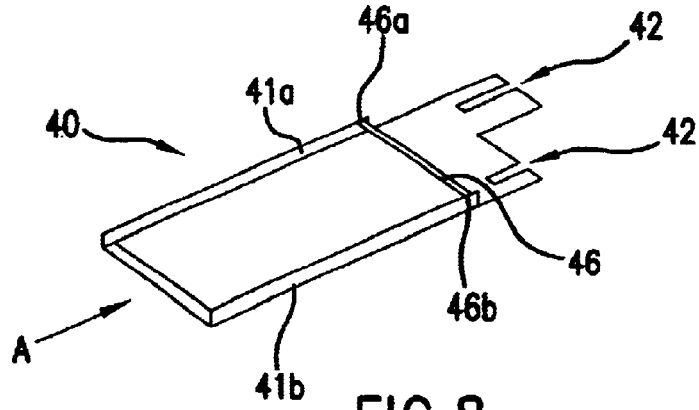
FIG. 8 schematically illustrates a static tensioning plate equipped with a retainer in accordance with a preferred embodiment of the invention.

A preferred tensioning mechanism for use in the present invention is a static tensioning plate 40, as shown in FIGS. 4 and 8. FIG. 4 illustrates an insert yarn 7 being fed from a bobbin 25 located in the rear of the winder through an optional break detector 75, across a static tensioning plate 40, and through the insertion guide 50. The static tensioning plate 40 not only ensures that the insert yarn 7 is delivered to the insertion guide 50 at an appropriate tension, but it also keeps the insert yarn 7 separate from the moving parts of the winder, such as the rotating spinning bobbins 5*a* and 5*b*, which could damage or break the insert yarn 7.

The break detector 75 can be any one of several commercially available devices. An example of a suitable break detector is a piezo-electric sensor available from Eltex of Sweden. The break detector 75 can be used in connection with suitable control means, for example, to stop operation and/or alert an operator of a break in the insert yarn 7.

The details of the static tensioning plate 40 in accordance with a preferred embodiment of the invention are illustrated in FIG. 8. The plate 40 is an elongate member having short walls 41*a* and 41*b* extending along the edges of the elongate member in its length direction. The insert yarn is fed in the direction of arrow A from below the plate 40 (so as to create tension), along its length between the walls 41*a* and 41*b*, and through the insertion guide 50 (not shown in FIG. 8). At the end of the plate opposite to where the insert yarn 7 is fed, a mounting bracket having two notches 42 is provided for attaching the plate 40 to the winder, using the pre-existing screws for the re-tie plate 55.

The static tensioning plate 40 preferably is provided with a retainer 46 for holding the insert yarn 7 between the retainer 46 and the tensioning plate 40. The retainer 40 prevents the insert yarn 7 from wandering into the portions of the winder above the tensioning plate 40 during operation. The retainer 46 shown in FIG. 8 is a bar having one end 46*a* welded to the wall 41*a*. As illustrated in FIG. 8, the retainer 46 can be positioned at the end of the tensioning plate 40 closest to the insertion guide 50. In some cases it may be advantageous to position the retainer 46 further away from the insertion guide than is shown in FIG. 8. The other end of the bar 46*b* is biased against the adjacent wall 41*b*. This configuration enables an operator to lift the unattached end of the retainer 46*b* to place an insert yarn between the retainer 46 and the tensioning plate 40.

Figure 9:
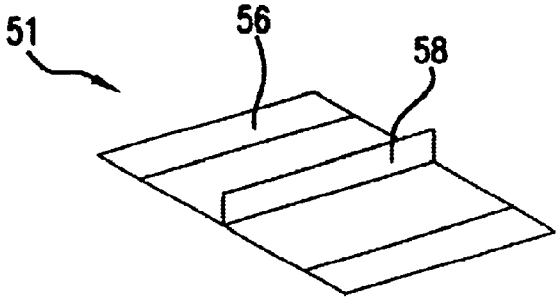
FIG. 9 schematically illustrates a retainer plate in accordance with an alternative embodiment of the invention.
Figure 10:
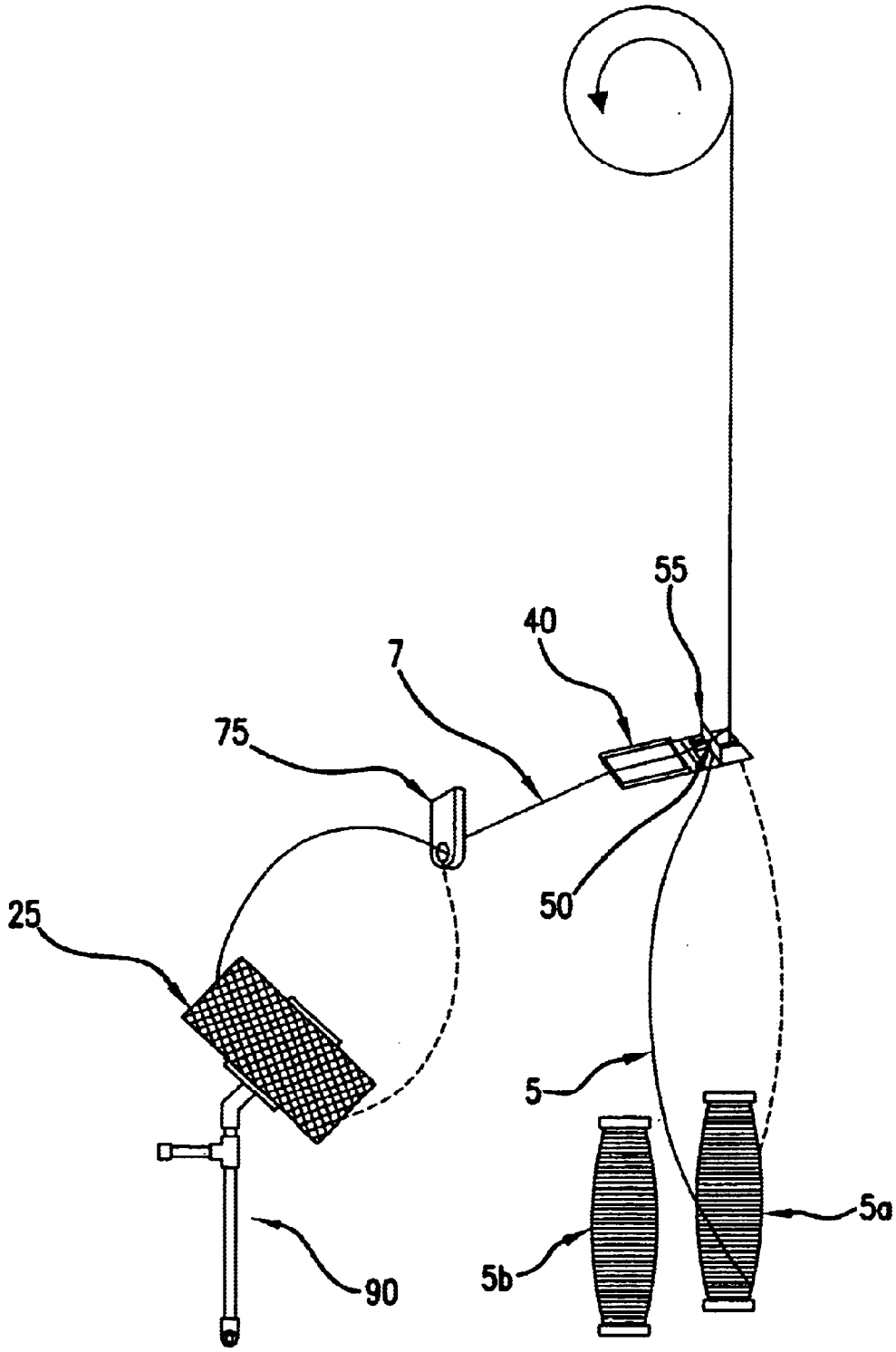
FIG. 10 schematically illustrates insert yarn 7, base yarn 5, and insertion guide 50.

FIG. 9 illustrates a plate-type retainer 51 in accordance with an alternative embodiment of the invention. The retainer 51 includes a plate 56 and an attached tab portion 58 for convenient handling. The retainer 51 has a size and shape that permits it to be inserted between the walls 41*a* and 41*b* of the static tensioning plate 40. The retainer 51 is placed over the insert yarn 7 on the static tensioning plate 40. The flat bottom of the plate 56 creates a drag force on the yarn as it is fed across the tensioning plate 40. The type of retainer 51 shown in FIG. 9 may be advantageous, for example, for creating additional tension when using insert yarns of heavier denier.

Figure 5A:
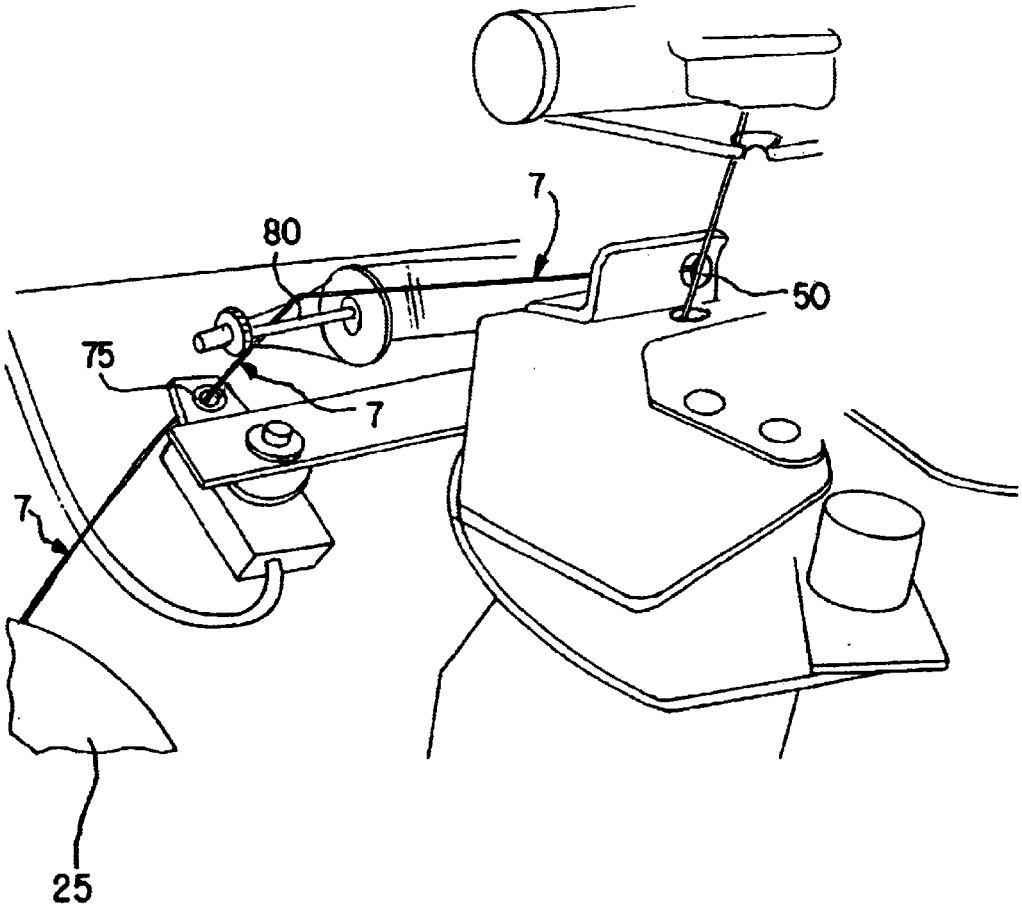
FIGS. 5A and 5B illustrate tensioning discs for tensioning an insert yarn in accordance with an alternative embodiment of the invention.
Figure 5B:
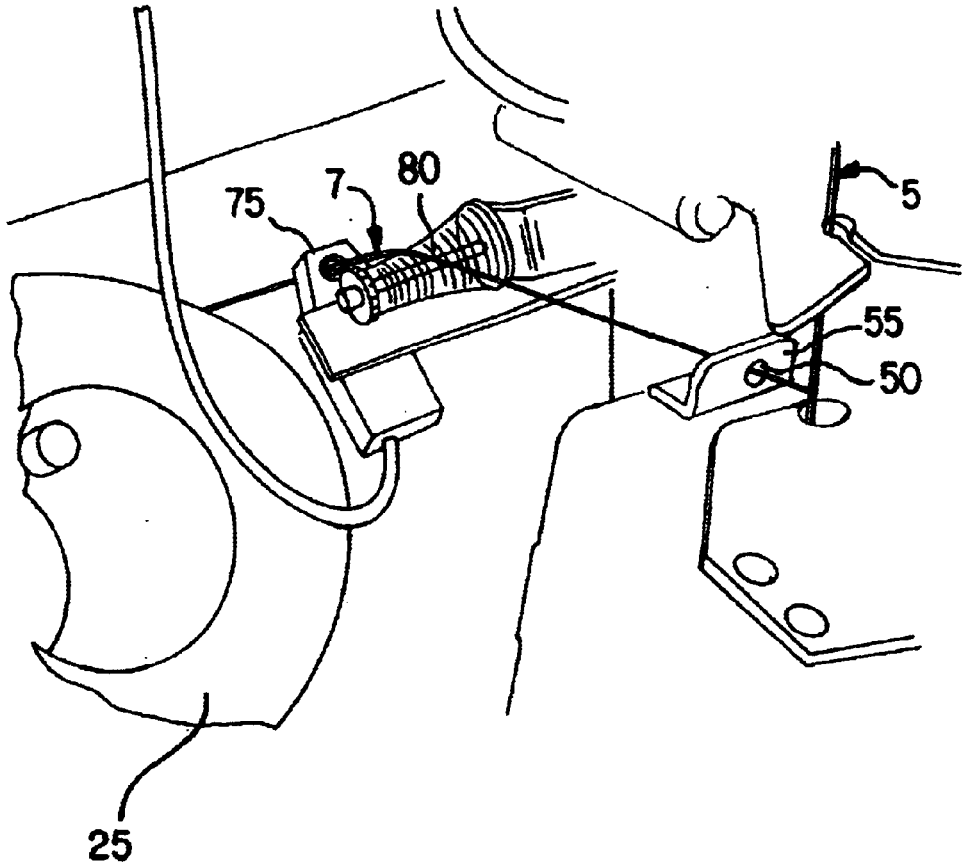

FIGS. 5A and 5B illustrate tensioning discs 80 that can be used for tensioning the insert yarn in accordance with an alternative embodiment of the invention. With reference to FIG. 5A, the insert yarn 7 is fed in the direction of arrow A from the bobbin 25 through the break detector 75, across the tensioning disc 80, and through the insertion guide 50. FIG. 5B is another view of the device in FIG. 5A but from more of a top perspective, showing the detail of the re-tie plate 55 and the insertion guide 50 therein. Such tensioning discs 80 are commercially available and the details of them are well known to persons skilled in the art.

The insert yarn bobbin 25 can be positioned at any convenient location, and the present invention should not be regarded as being limited to any particular arrangement for supplying or feeding the insert yarn 7. By way of example, the insert yarn 7 can be fed from the front of the winder, from above the winder, or from behind the winder. The insert yarn bobbin 25 can be held by a holder 90 attached to the winder frame 95 or by a separate stand (not shown). Preferably, an insert yarn bobbin holder 90 is mounted to a rear portion of the winder frame 95. The winder frame 95 may contain several (e.g., 6 to 8 or more) automatic winders 100. One insert yarn bobbin holder 90 can be mounted to the frame 95, for example, for each winder present on the frame 95 or for each winder being used to wind two-ply yarns.

The rear-mounted insert yarn bobbin 25 can be easily assessed from the rear of the winder by an operator, e.g., for maintenance or replacement. Unlike the conventional creel frame insertion apparatus, this configuration makes efficient use of valuable floor space, while leaving the area in the front of the winder available for operators. Additionally, when feeding low denier yarns, it is preferable to minimize the distance from the bobbin to the winder to reduce the risk of breakage.

Figure 6A:
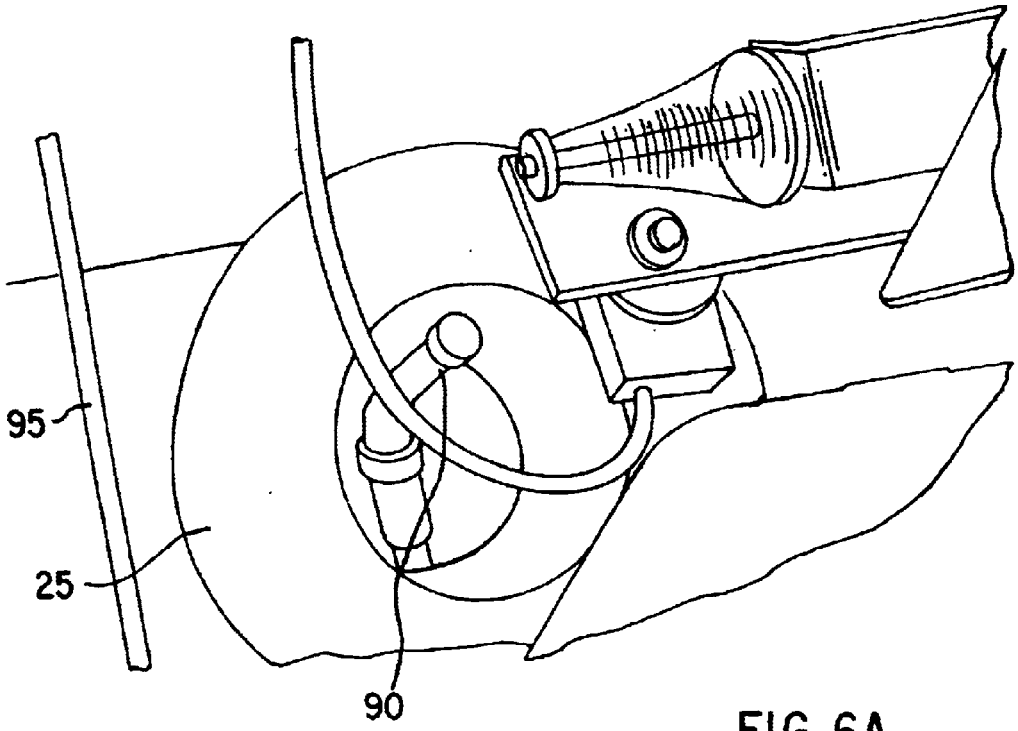
FIGS. 6A (front view) and 6B (rear view) illustrate an insert yarn bobbin holder in accordance with a preferred embodiment of the invention.
Figure 6B:
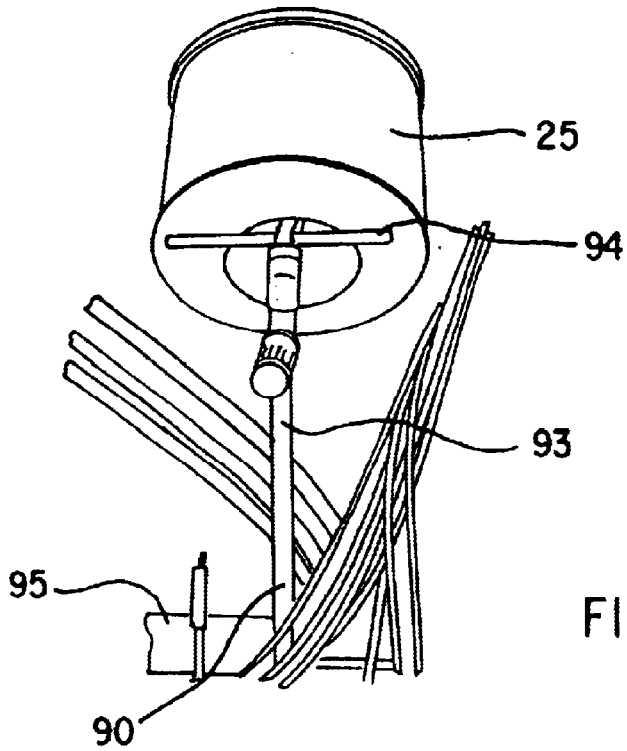
Figure 7:
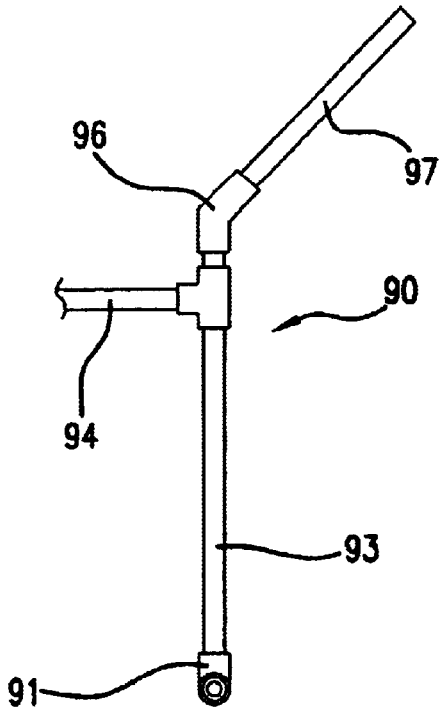
FIG. 7 schematically illustrates a side view of an insert yarn bobbin holder in accordance with a preferred embodiment of the invention.

FIG. 6B shows a rear view of the insert yarn bobbin holder 90 while holding an insert yarn bobbin 25. FIG. 7 schematically illustrates a side view of the insert yarn bobbin holder 90. The bottom portion of the holder 90 is mounted to the winder frame 95 by a bracket 91. The holder 90 has a vertical portion 93 that extends to an angled joint 96 from which an extension member 97 extends, e.g., at a 45° angle. The insert yarn bobbin 25 is placed over the extension member 97 until it abuts a horizontal support 94 attached to the vertical portion 93. The extension member 97 and horizontal support 94 permit rotation of the bobbin 25 as the insert yarn is unwound and fed to the winder.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention, which is limited only by the appended claims.

What is claimed is:

1. An insertion mechanism for bringing an insert yarn into association with a base yarn in an automatic winder of the type in which a base yarn is drawn out from a layer of yarn on a spinning bobbin and is rewound onto a package, the insertion mechanism comprising:

an insertion guide for feeding the insert yarn to a predetermined location;

a tensioning device for maintaining tension on the insert yarn, wherein the tensioning device comprises a static tensioning plate having a length dimension and a width dimension; and a mounting bracket adapted to permit attachment of the insertion mechanism to an automatic winder.

2. The insertion mechanism of claim 1 further comprising a retainer for holding the insert yarn between the retainer and the static tensioning plate.

3. The insertion mechanism of claim 2 wherein the retainer comprises a bar traversing at least a portion of the width dimension of the static tensioning plate.

4. The insertion mechanism of claim 2 wherein the retainer comprises a plate having a substantially planar surface for engaging the insert yarn.

5. The insertion mechanism of claim 2 wherein the mounting bracket is integral with the static tensioning plate.

6. An automatic winder for drawing out a base yarn from a layer of yarn on a spinning bobbin and rewinding the base yarn together with an insert yarn onto a package, the automatic winder comprising:

a winding unit operable for drawing out a layer of base yarn from a spinning bobbin and rewinding the base yarn together with an insert yarn onto a package;

an insertion guide for feeding an insert yarn to a predetermined location of the automatic winder; and a tensioning device for maintaining tension on the insert yarn as it is fed to the predetermined location, wherein the tensioning device comprises a static tensioning plate having a length dimension and a width dimension.

7. The automatic winder of claim 6 further comprising a retainer for holding the insert yarn between the retainer and the static tensioning plate.

8. The automatic winder of claim 7 wherein the retainer comprises a bar traversing at least a portion of the width dimension of the static tensioning plate.

9. The automatic winder of claim 7 wherein the retainer comprises a plate having a substantially planar surface for engaging the insert yarn.

10. A method of rewinding a base yarn from a layer of yarn on a spinning bobbin onto a package together with an insert yarn, the method comprising:

providing an automatic winder having a winding unit operable for drawing out a base yarn from a spinning bobbin and rewinding the base yarn together with an insert yarn onto a package;

feeding an insert yarn to a predetermined location of the automatic winder and into association with the drawn-out base yarn while maintaining tension on the insert yarn wherein tension is maintained on the insert yarn by passing the insert yarn over a static tensioning plate; and winding the base yarn and insert yarn together onto a package.

11. The method of claim 10 wherein the insert yarn is retained against the static tensioning plate with a retainer.

12. The method of claim 10 wherein the base yarn comprises fibers selected from the group consisting of polyester, nylon-6, nylon-6,6, polypropylene, acrylic, and wool.

13. The method of claim 12 wherein the insert yarn comprises fibers selected from the group consisting of polyester, nylon-6, nylon-6,6, polyamide copolymers, LYCRA®, spandex, and acrylic.

14. The method of claim 12 wherein the insert yarn comprises electrically conductive fibers.

* * * * *

UNITED STATES PATENT AND TRADEMARK OFFICE

CERTIFICATE OF CORRECTION

PATENT NO. : 6,755,366 B2
DATED : June 29, 2004
INVENTOR(S) : James E. Polk

It is certified that error appears in the above-identified patent and that said Letters Patent is hereby corrected as shown below:

Title page,
Item [56], References Cited, FOREIGN PATENT DOCUMENTS, please replace "EP 0 327 773 B1" with -- EP 0 324 773 B1 --

Signed and Sealed this

Thirty-first Day of May, 2005

JON W. DUDAS
*Director of the United States Patent and Trademark Office*